United States Patent [19]

Lockhart, Jr. et al.

[11] Patent Number: 5,004,185

[45] Date of Patent: Apr. 2, 1991

[54] AIR-SURFACE-MISSILE DATA LINK SYSTEM

[75] Inventors: John C. Lockhart, Jr., Oreland, Pa.; Standish C. Hartman, Flemington, N.J.; Bruce R. Meuron, Willow Grove; Joseph B. Lyons, Jr., Philadelphia, both of Pa.

[73] Assignee: The United States of America as represented by the Secretary of the Navy, Washington, D.C.

[21] Appl. No.: 394,388

[22] Filed: Aug. 31, 1964

[51] Int. Cl.[5] ..... F41G 7/00

[52] U.S. Cl. ..... 224/3.14; 244/14; 328/63; 328/73; 328/155; 455/1

[58] Field of Search ..... 325/30, 58, 32; 178/22, 178/3, 5.1, 69.5, 6.8; 328/155, 55, 187, 63, 72, 73; 235/150.21, ; 244/14, 77, 3.14; 340/172.5, 204, 293

[56] References Cited

U.S. PATENT DOCUMENTS

| | | | |
|---|---|---|---|
| 2,792,190 | 5/1957 | Seibold | 244/14 |
| 2,861,179 | 11/1958 | Jacob | 244/14 |
| 2,934,604 | 4/1960 | Bizet | 178/69.5 |
| 2,980,858 | 4/1961 | Grondin et al. | 328/155 |
| 2,993,089 | 7/1961 | Negri | 178/22 |
| 3,037,568 | 6/1962 | Hannum | 179/15 |
| 3,038,028 | 6/1962 | Henze | 178/22 |
| 3,053,478 | 9/1962 | Davenport et al. | 244/14 |
| 3,069,657 | 12/1962 | Green et al. | 340/171 |
| 3,095,539 | 6/1963 | Bennett et al. | 325/163 |
| 3,099,795 | 7/1963 | Frank | 325/30 |
| 3,099,796 | 7/1963 | Zadaff | 325/30 |
| 3,110,862 | 11/1963 | Chasek | 325/30 |
| 3,113,291 | 12/1963 | Fiske | 340/23 |
| 3,117,305 | 1/1964 | Goldberg | 340/171 |
| 3,119,964 | 1/1964 | Arefth | 325/130 |
| 3,121,197 | 2/1964 | Irland | 325/130 |
| 3,180,927 | 4/1965 | Heppe | 178/5.1 |

*Primary Examiner*—Nelson Moskowitz
*Attorney, Agent, or Firm*—James V. Tura; James B. Bechtel; Susan E. Verona

[57] ABSTRACT

This invention relates to an aircraft missile communication system comprising means to generate a digital sequence corresponding to command signals, means in the aircraft to mix the digital command sequence with the code sequence and transmit the combination to an object; means to compare the received code sequence with the second digital code sequence and means in said object depended upon the comparing means to express said digital command sequence.

6 Claims, 4 Drawing Sheets

AIR-SURFACE-MISSILE DATA LINK SYSTEM

The invention described herein may be manufactured and used by or for the Government of the United States of America for governmental purposes without the payment of any royalties thereon or therefor.

This invention relates to a command data link and TV return link system for an air-to-surface missile.

In the Condor Missile System an air-to-ground missile is launched from an aircraft which then stands off a considerable distance, anywhere from 40 to 100 miles or more. In order to guide the missile correctly from the aircraft it is necessary to have contact with the missile over a sizable distance and also to know how far from the aircraft the missile is at any moment. Also desirable is a TV link which enables the operator in the aircraft to see what view is presented to the missile in the course of its flight. Prior aircraft-to-missile communications systems have suffered by being susceptible to jamming, i.e., signals similar to those issued by the aircraft or by the missile have been issued by unfriendly jamming stations which result in false signals being given to the missile or the aircraft or both. These jamming signals had the undesirable effects of interfering with the aircraft control commands to the missile, thereby sending the missile off course. They also had the effect of disrupting TV communication by issuing spurious sync pulses which resulted in a scrambling of the TV picture at the aircraft.

The present invention provides a coded communications system which provides protection against jamming by providing coded command signals and by providing coded intervals in place of the usual return sync pulses in the TV signal. To accomplish this, the aircraft utilizes a random code generator in which command data signals modulate the code train which in turn modulates the RF carrier. This missile contains a second code generator with a code searching mechanism which synchronizes the second code generator with the first generator. Then comparison of the second code generator signal with the received signal produces the command signals as an output. The code generator in the missile also transmits its code back to the aircraft during the blank periods in the horizontal scan of the TV signal. This signal is then synchronized with a third code generator. A spurious signal which does not match the code of the aircraft or missile would be ignored by the code searching mechanism in both the aircraft and missile. The second code generator in the missile is then used to synchronize the scan of the TV camera, and the third code generator in the aircraft is used to synchronize the horizontal and vertical sweep in the video monitor to provide the TV synchronization. The third code train is also then compared in phase with the first generated code train and the difference in time between the two is the length of time that it takes the signal to travel from the aircraft to the missile and back to the aircraft.

Accordingly, it is an object of the present invention to provide an aircraft-to-missile communications system which by coded signals provides a high degree of immunity to jamming signals.

Another object of the invention is to provide a system using coded command signals to guide the missile.

Another object of the invention is to provide a system with a coded TV link whereby the timing is provided by internal sync means.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figures 1, 2:
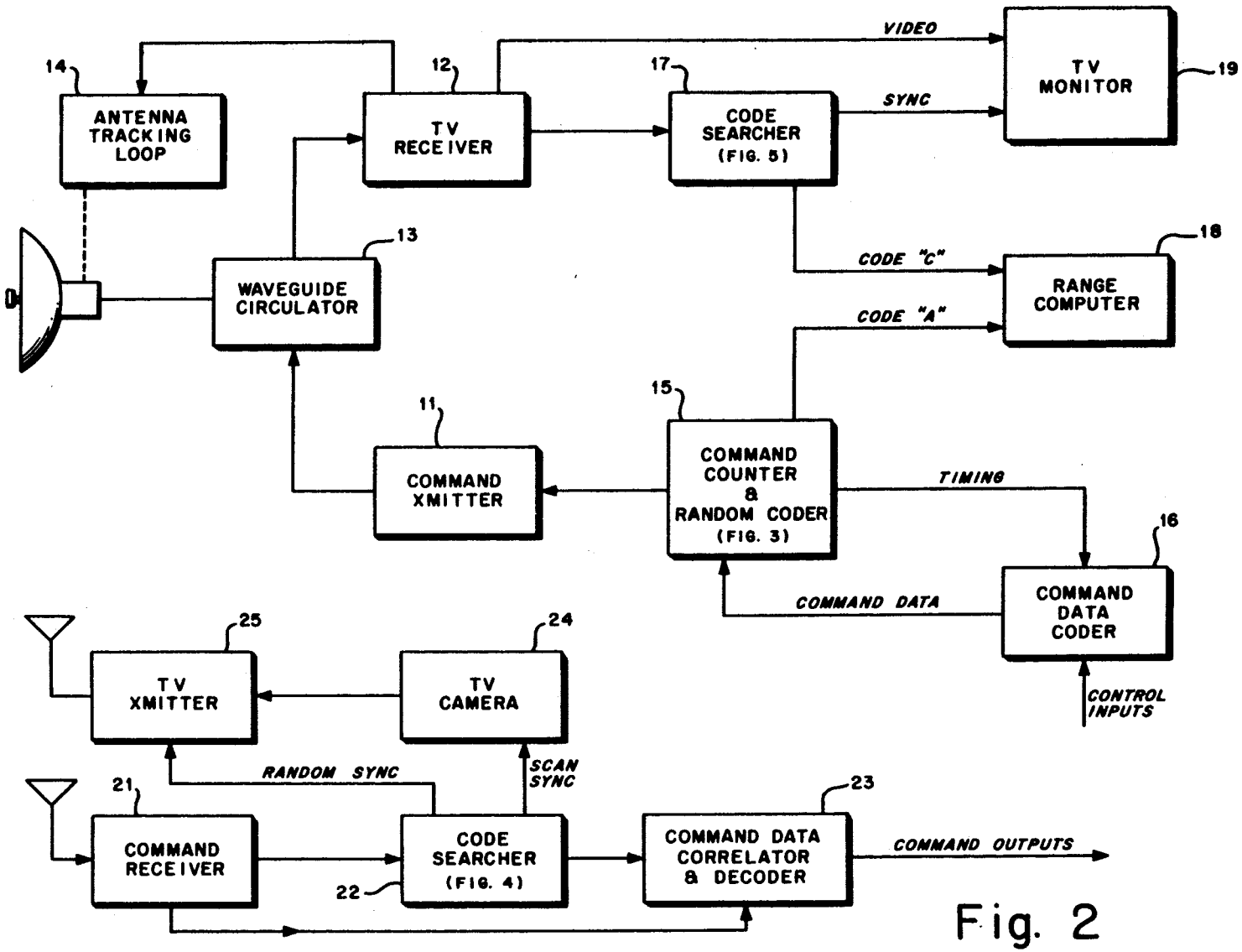
FIG. 1 shows a block schematic diagram of a data and TV communications system according to the present invention in an aircraft.
FIG. 2 shows a block schematic diagram of a data and TV link according to the invention in a missile.

In FIG. 1 there is disclosed a conventional two way communications system employing a transmitter 11, receiver 12, waveguide circulator 13, and antenna tracking loop 14. The function of the waveguide circulator 13 is to separate incoming signals from outgoing signals and pass them to their respective points. The function of the antenna tracking loop 14 is to keep the antenna of the aircraft directed in the direction from which received signals are coming. The operation of the transmitter 11, receiver 12, circulator 13 and tracking loop 14 are well known in the art and will not be described here. Associated with the command transmitter 11 is a command counter and random coder 15. This command counter contains the code generator "A" which controls the operation and provides the timing for the entire system. The counter-coder 15 is provided with serial digital data from a command data coder 16 which is controlled by the timing from command counter 15. The command counter and random coder 15 are described in greater detail in connection with FIG. 3 below. Connected to the TV receiver 12 is a code searcher 17, described in greater detail in connection with FIG. 5 below. The function of the code searcher is to accept the code portions of the received signal and to synchronize a code generator "C" and counter contained within the code searcher with the received code portions. This code searcher 17 and the command counter and random coder 15 each send a timing signal at a certain point in their codes to a range computer 18. The function of the range computer 18 is to measure the time between the corresponding portions of the code A from the command counter and random coder 15 and code C from code searcher 17 and express the distance to the missile as a function thereof. TV receiver 12 sends the video portion of its received TV signal to a TV monitor 19 which is synchronized by sync information from code searcher 17.

In FIG. 2 a command receiver 21 in the missile receives the signal from the aircraft and sends it to a code searcher 22. This code searcher 22 is described in greater detail in connection with FIG. 4 below. It is similar in operation to the code searcher 17 in the aircraft. Its function is to synchronize an internally contained code generator "B" and counter with the code sequence in the received signal. A command data correlator and decoder 23 receives the incoming code signal from command receiver 21 and decodes it with the aid of a code sequence and timing information from code searcher 22. The code searcher 22 also provides scan sync information, both vertical and horizontal, for a camera 24. The camera 24 passes its video information to a TV transmitter 25 which also receives portions of the code generator sequence from code searcher 22 in the blanking portions of the horizontal sweep from the TV camera. The combination of this information is then transmitted by transmitter 25 back to the aircraft.

In a copending application, Ser. No. 370,741, of Bruce R. Meuron and Joseph B. Lyons, Jr. for ASM Data Link and Return Link, filed May 27, 1964, the command data coder 16, the command data correlator-decoder 23, the range computer 18 and the code searching mechanisms 17 and 22 are disclosed in greater detail and claimed. The range computer 18, the command data coder 16, and the command data correlator-decoder 23 will not be described in detail here as only their broad functions are necessary to the present invention. For details thereof, reference may be made to the above-cited application of Meuron and Lyons. The code searching mechanisms 17 and 22 will be described only to the extent necessary in the system.

Figure 3:
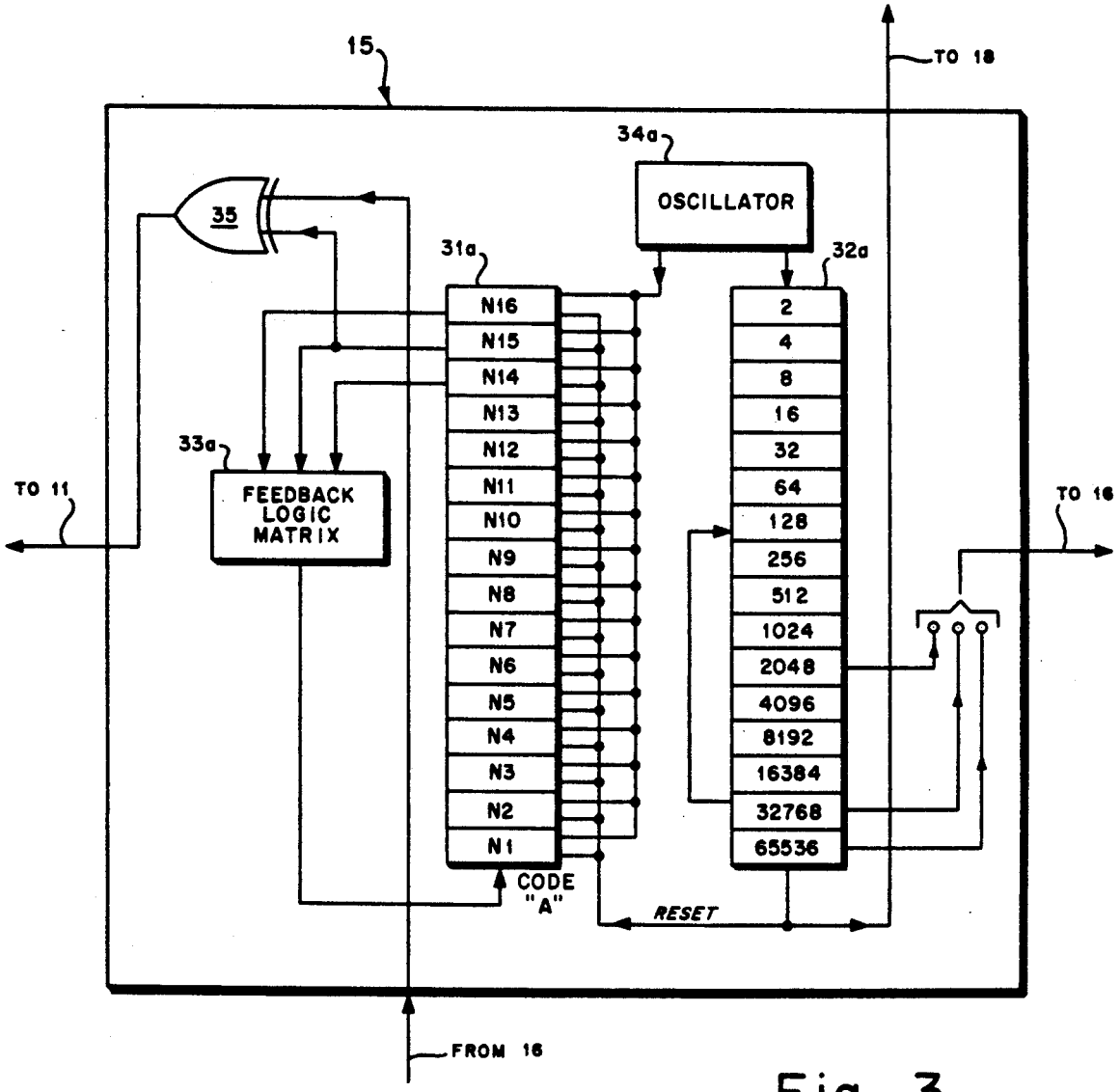
FIG. 3 shows a command counter and random coder in the aircraft system of FIG. 1.

In FIG. 3 shift register 31*a* is a code generator with sixteen positions which is reset periodically by a signal from a binary counter 32*a* also having sixteen positions. Signals are led from the fourteenth, fifteenth and sixteenth positions of shift register 31*a* to a feedback logic matrix 33*a* which sends a signal back to the first position of shift register 31*a*. Register 31*a* and counter 32*a* are fed clock pulses periodically by an oscillator 34*a*. The clock pulses from oscillator 34*a* go only to the first position of counter 32*a* but they go to all positions of register 31*a*. Because of the clock pulses coming in to all positions and because of the feedback means through feedback logic matrix 33*a*, register 31*a* will generate a code sequence of "1's" and "0's" from any one of its positions. This coded sequence generated will be approximately 65,000 bits long before a repeat. Register 31*a* will periodically be reset by counter 32*a* as register 31*a* reaches the end of its cycle. The period of counter 32*a* will be reduced somewhat from its total of 65,536 by feedback means from the zero position of the 32,768 position to the 128 position, as shown in FIG. 3.

Timing information is led out from three positions of counter 32*a* to control the operation of the command data coder 16 as indicated in FIG. 3. The reset signal from counter 32*a* which goes to register 31*a* also goes to the code input of the range computer 18. The code sequence output from the fifteenth position of register 31*a* goes to an Exclusive OR gate 35 which mixes it with digital command data from command data coder 16. An Exclusive OR gate provides a digital output when the two inputs are of different logic states, but no output when the inputs are of the same state. The output of this Exclusive OR gate is sent to the command transmitter 11.

Figure 4:
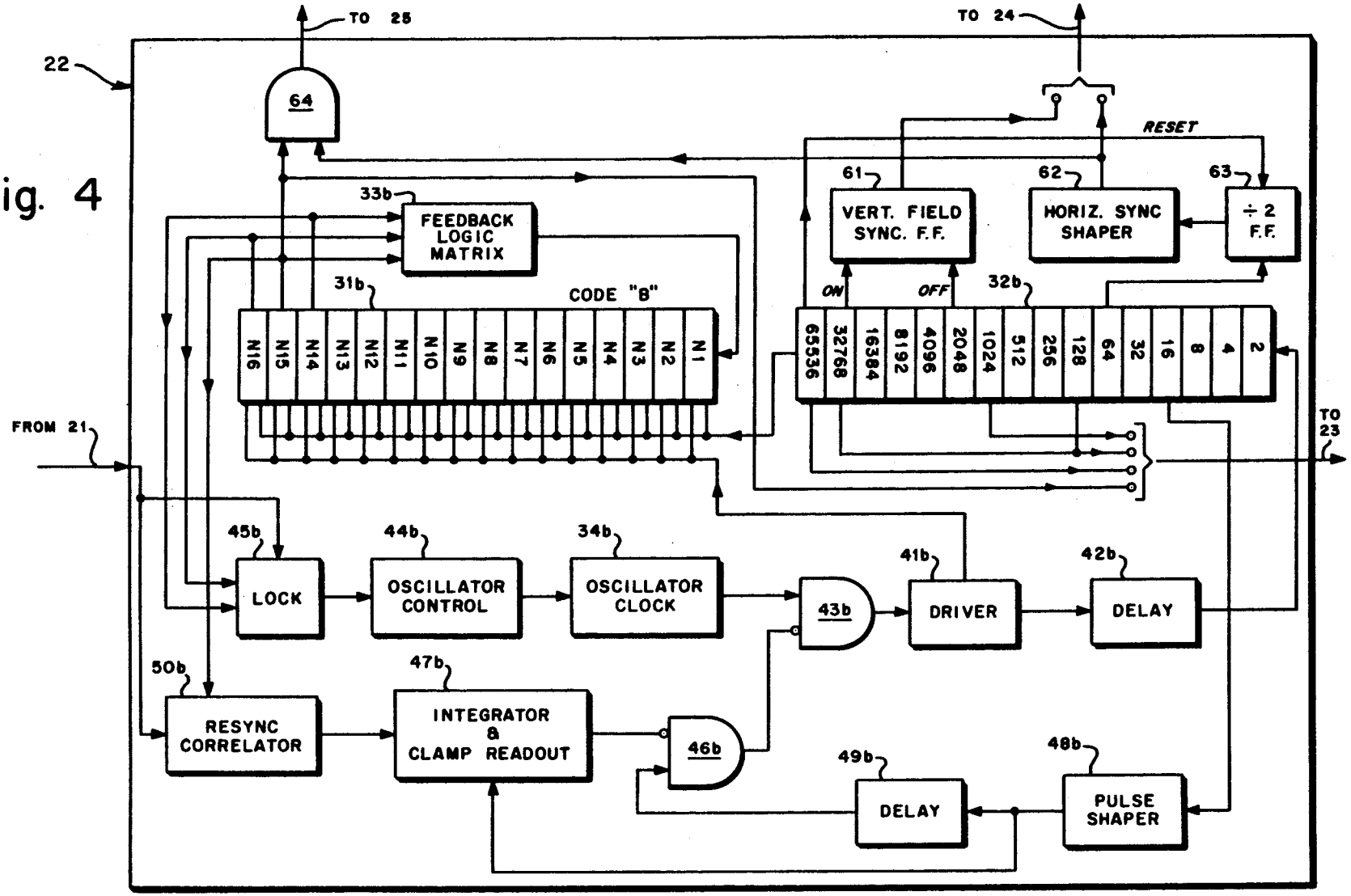
FIG. 4 shows a code searcher in the missile system of FIG. 2.

In the missile code searcher mechanism 22, shown in FIG. 4, there is a second shift register 31*b* identical to shift register 31*a*. Register 31*b* is reset by the counter 32*b* which is identical to counter 32*a*. A feedback logic matrix 33*b* identical to feedback logic matrix 33*a* is linked in the same manner to register 31*b* providing a second register generating a code sequence identical to that generated by register 31*a*. A driver 41*b* provides the clock pulses for register 31*b* and through a delay line 42*b* to the counter 32*b*. Driver 41*b* is driven in turn by the output of an inhibit gate 43*b* which in turn receives its drive from an oscillator clock 34*b* which is similar to oscillator 34*a* in FIG. 3 except that clock 34*b* is controlled by an oscillator control 44*b*. Oscillator control 44*b* is in turn controlled by a signal from a lock means 45*b*. Inhibit gate 43*b* is enabled by the absence of a signal from inhibit gate 46*b* which is ordinarily off; that is, with a logical "1" from oscillator clock 34*b* and a logical "0" from the inhibit gate 46*b*, inhibit gate 43*b* provides a logical "1" output. In all other logical input conditions, inhibit gate 43*b* provides a logical "0" output. Inhibit gate 46*b* will be off under either of two conditions, if there is an output from a clamp readout 47*b*, or if there is no output from a pulse shaper 48*b* through a delay line 49*b*. Pulse shaper 48*b* receives a pulse signal every sixteenth clock pulse from the counter 32*b*, and it provides a pulse through the delay line 49*b* to inhibit gate 46*b* and also to the integrator and clamp readout 47*b*. The code sequence from the fifteenth position of the register 31*b* is led into a resync correlator 50*b* to which is also led the received code signal from command receiver 21. The received code signal from command receiver 21 also passes through the lock means 45*b* . This function will be described subsequently.

The operation of the code searching mechanism is as follows. The coded signal comes in to the resync correlator from command receiver 21 and is compared with the code signal generated from the fifteenth stage of register 31*b*. Assuming that at the outset the two code signals are not correlated, the resync correlator 50*b* will send to the integrator and clamp readout 47*b* approximately as many pulses of one polarity as of the other polarity. The net integration of these pulses on the integrator and clamp readout 47*b* will be around zero. Every sixteenth clock pulse a pulse from pulse shaper 48*b* timed from the sixteenth position of counter 32*b* will discharge the clamp readout 47*b*. If there has been less than a certain level of correlation there will be no output from clamp readout 47*b* into inhibit gate 46*b*. If there is no output from clamp readout 47*b* at the same time there is a pulse into inhibit gate 46*b* from pulse shaper 48*b* through delay line 49*b*, inhibit gate 46*b* will be enabled. Enabling inhibit gate 46*b* will disable inhibit gate 43*b*. Disabling of inhibit gate 43*b* will delay one clock pulse from oscillator clock 34*b* into driver 41*b*, thereby holding back the operation of register 31*b* and counter 32*b* for one pulse. This will occur every sixteenth clock pulse from counter 32*b*. The other fifteen pulses of the sixteen pulses from oscillator clock 34*b* pass through inhibit gate 43*b* without difficulty because there is no pulse into pulse shaper 48*b*. The effect of this repeated comparison of the received coded signal with the generated coded signal is to delay the operation of the register 31*b* and counter 32*b* one pulse every sixteenth pulse from oscillator clock 34*b* until there is correlation indicated in resync correlator 50*b*. When correlation is indicated in resync correlator 50*b* integrator and clamp readout 47*b* will give a pulse output into inhibit gate 46*b*. This will disable inhibit gate 46*b* which in turn will enable inhibit gate 43*b* for that pulse. Once register 31*b* and counter 32*b* are correlated with the received coded signal inhibit gate 46*b* will always be disabled, inhibit gate 43*b* will always be enabled, and oscillator clock 34*b* will continue to drive register 31*b* and counter 32*b* without interruption.

The signals from the fourteenth and sixteenth stages of the register 31*b* are led to a lock means 45*b* where they are compared with the signal from the command receiver 21. The specific operation of this lock means is described and claimed in an application, Ser. No. 394,389, filed Aug. 31, 1964 by John C. Lockhart, Jr. for Lock Means and TV Sync for ASM filed concurrently herewith to which reference may be had for the details thereof. The function of the lock means is to hold the signal once synchronized in synchronization with the code generated in the fifteenth stage of the register 31*b*.

Timing information is led from the appropriate stages of counter 32*b* into a vertical sync flip-flop 61. The vertical sync flip-flop 61 is turned on by the ON signal. This sends an ON signal to a retrace scan control point in the TV camera 24. Shortly thereafter a signal from the 2048 position of counter 32*b* turns the vertical sync flip-flop off again and the camera resumes scanning. Horizontal sweep timing for the TV camera 24 is provided by a horizontal sync shaper 62 which receives its timing through a divide-by-two flip-flop 63 from the 64 position of counter 32*b*. When counter 32*b* reaches the end of its cycle it sends a reset signal to the divide-by-two flip-flop 63. During the blanking portion of the TV camera scan horizontal sync shaper 62 sends a pulse to an AND gate 64 which enables AND gate 64 to pass a code sequence from the fifteenth stage of register 31*b*. This portion of the code sequence passes through AND gate 64 to the TV transmitter where it is transmitted by the TV transmitter 25 back to the aircraft during the blanking portions of the TV camera scan.

Figure 5:
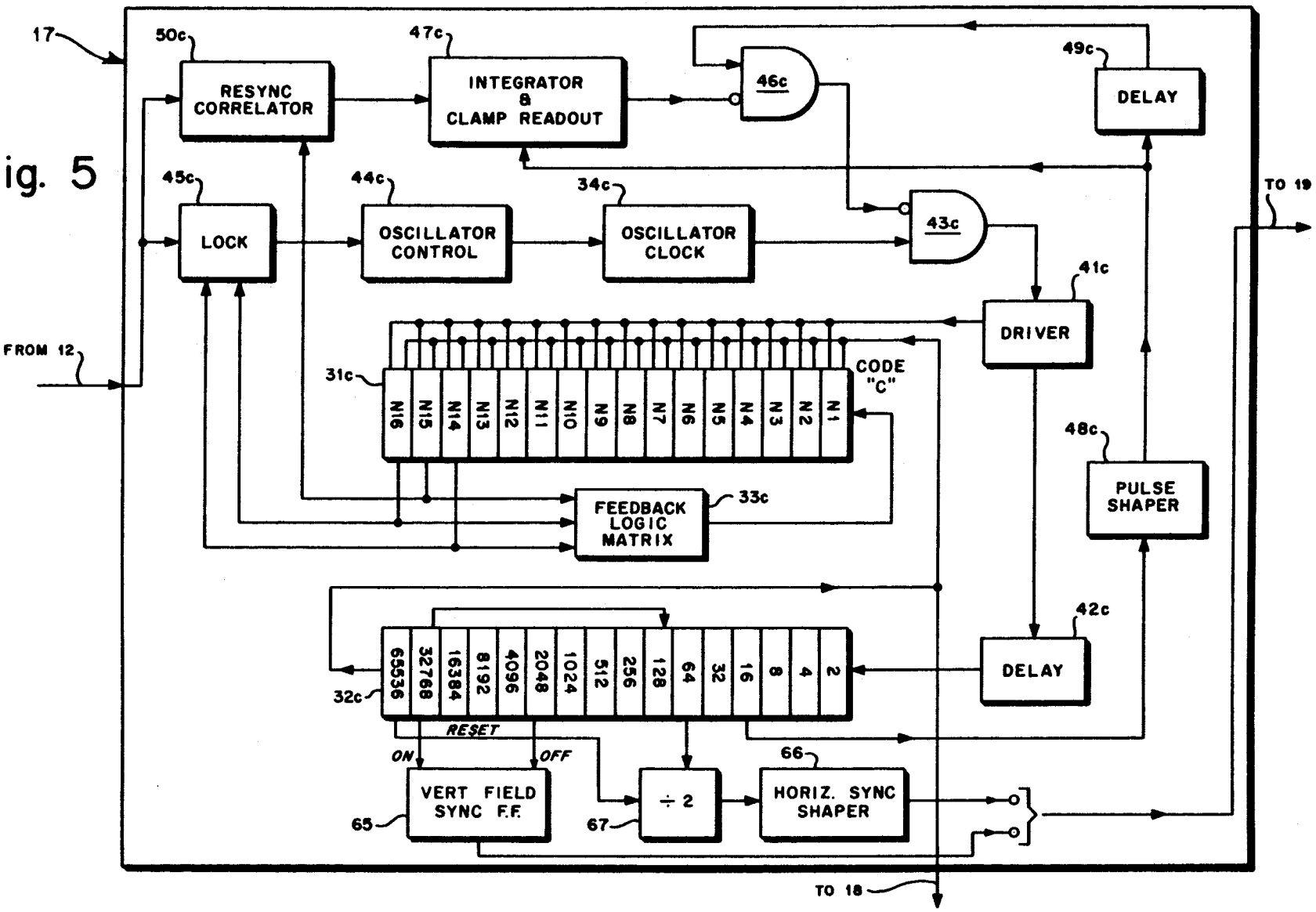
FIG. 5 shows a code searcher in the aircraft system of FIG. 1.

In FIG. 5 the code searcher in the aircraft is more or less similar to that of the missile and similar parts are similarly numbered and have similar functions. Counter 32*c* provides the control of register 31*c* by providing a reset signal when counter 32*c* reaches the end of its cycle. This reset signal is also passed to the code C input of range computer 18 where the comparison with code A is made to determine the distance from the missile to the aircraft. Appropriate timing information is also sent to the vertical sync flip-flop 65 and a horizontal sync shaper 66 through a second divide-by-two flip-flop 67 which provide horizontal and vertical sync information to the TV monitor, which also receives the video signals from TV receiver 12, as shown in FIG. 1.

The operation of the system will now be described. Shortly after the missile is launched from the aircraft, code A is generated by the random coder 15 which is transmitted by the aircraft to the missile. This code information will be received by the command receiver 21 in the missile which will send it to the code searcher 22. Code searcher 22 using its code searching mechanism will rotate the cycle in the code generator "B" of the missile until code generator "B" and code generator "A" in the aircraft are synchronized. Since the bit rate of the oscillator clocks in the aircraft and missile is in the neighborhood of two megacycles this process takes at most about one or two seconds. The code generated by generator "B" in the missile is also sent back through the TV transmitter 25 to the aircraft where it is in turn searched by code searcher 17, and code generator "C" is in turn synchronized with the received signal from the missile. The relative timing of code C and code A may be used directly in the range computer 18 to determine distance to the missile at any time. After about one or two seconds the code searching mechanisms in the missile and aircraft are disconnected and reliance is put on the lock means 45 to hold the code generators in synchronization.

Once the three code generators are synchronized the operator can control the travel of the missile by means of control inputs into the command data coder 16. Command data coder 16 translates these control inputs into serial command data which is fed into the command counter and random coder 15 which mixes it with the generated code A. This command data modulated code is then fed into the command transmitter 11 which is then sent to the missile. This command data modulated code signal is received by the command receiver 21 and passes directly to the command data correlator and decoder 23, where it is compared with the generated code B from code searcher 22. Command data correlator-decoder 23 translates the comparison of the two coded signals into specific command outputs which are then fed to the control points of the missile to guide its path. Scan sync information from code generator "B" is also sent to the TV camera 24 which controls the scan information of the TV camera. However, this scan sync information is not in itself sent to the TV transmitter for rebroadcast but only the video portion of the TV picture is sent to the transmitter 25. In the blanking intervals of the scan the random code from code searcher 22 is sent to the transmitter and back to the aircraft. In the aircraft the received signal, which consists of video signals with a portion of a code in the blanking intervals is sent to the TV receiver. The video portion is sent directly to the TV monitor 19, while the code portion is sent to the code searcher 17 to hold it in sync by means of the lock means 45*c*. Code searcher 17 by means of code generator "C" sends sync information to TV monitor 19 controlling the showing of the picture on the monitor screen.

Initially, only the code B is sent back to the aircraft from the missile to synchronize code C. After synchronization, standard switching means (not shown) bring in the video signals for transmission as shown.

It may be shown that the control of the missile and synchronization of the TV transmission are strongly resistant to jamming potentially providing resistance to jamming of the order of 30 decibels higher than the transmitted signal.

It will be understood that various changes in the details and arrangements of parts, which have been herein described and illustrated in order to explain the nature of the invention, may be made by those skilled in the art within the scope of the invention as expressed in the appended claims.

What is claimed is:

1. An aircraft-missile communications system in which an aircraft and a missile interchange information by coded signals comprising:

first code means in the aircraft to generate a first digital code sequence;

transmitter means in the aircraft to transmit said first digital code sequence;

receiver means in the missile to receive said first digital code sequence;

second code means in the missile to generate a second digital code sequence the same as said first digital code sequence and having scan sync information contained therein;

synchronizer means in the missile to synchronize said second digital code sequence with said first digital code sequence;

transmitted means in the missile to transmit said second digital code sequence;

receive means in the aircraft to receive said second digital code sequence third code means in the aircraft to generate a third digital code sequence the same as said second digital code sequence and having scan sync information contained therein; and synchronize means in the aircraft to synchronize said third digital code sequence with said second digital code sequence.

whereby said digital codes are synchronized for the interchange of information between the aircraft and the missile.

2. An aircraft-missile communications system as recited in claim 1 further comprising:

lock means in the missile to hold said second digital code sequence in synchronization with said first digital code sequence; and lock means in the aircraft to hold said third digital code sequence in synchronization with said second digital code sequence.

3. An aircraft-missile communications system as recited in claim 1 further comprising:

a television camera in the missile;

a television monitor in the aircraft; control means in the missile to control the scan of said television camera by reference to the scan sync information of said second digital code sequence; and control means in the aircraft to control the sweep of said television monitor by reference to the scan sync information of said third digital code sequence.

4. An aircraft-missile communications system as recited in claim 1 further comprising:

code means in the aircraft to generate a fourth digital code sequence corresponding to desired command signals;

mixer means in the aircraft to provide a command code sequence by combining said first and fourth digital code sequences, said command code sequence being transmitted by said aircraft transmitter means after all said digital code sequences are synchronized and being received by said missile receiver; and decoder means in the missile responsive to said received command code sequence and said second digital code sequence to provide command output signals for guiding the missile.

5. An aircraft-missile communications system comprising:

first means to generate a first digital code sequence;

means to transmit said first digital code sequence;

means to receive said code sequence;

second means to generate a second digital code sequence substantially similar to said first sequence;

means to compare said second sequence with said first sequence periodically;

means to delay said sequence periodically until synchronization with said first sequence is indicated by said comparing means;

clock means issuing digital pulses at a predetermined rate for driving said second means to generate said second digital code sequence;

means for interrupting said clock pulses periodically until synchronization is indicated, said means for interrupting comprising:

a first inhibit gate inhibited periodically by noncorrelation signals from said comparing means.

6. An aircraft-missile communications system as recited in claim 5 wherein said interrupting means further includes:

integrating means summing the correlation and noncorrelation signals from said comparing means and discharged periodically by predetermined points of said code sequence;

and a second inhibit gate giving an inhibiting signal to said first inhibit gate upon coincidence of a discharge signal from said predetermined points of said code sequence and a non-correlation signal from said integrating means.

* * * * *